US005520405A

United States Patent [19]

Bourke

[11] Patent Number: 5,520,405

[45] Date of Patent: May 28, 1996

[54] SNOWBOARD BINDING AND BOOT INCLUDING COMPLEMENTARY OPENING AND BINDING MEMBER

[76] Inventor: Lyle J. Bourke, P.O. Box 623, Londonderry, Vt. 05148

[21] Appl. No.: 288,017

[22] Filed: Aug. 10, 1994

[51] Int. Cl.[6] ..... A63C 9/02

[52] U.S. Cl. ..... 280/613; 280/14.2; 36/131

[58] Field of Search ..... 36/131, 113, 132; 280/630, 613, 618, 14.2; 74/594.6, 348; 403/348

[56] References Cited

U.S. PATENT DOCUMENTS

| | | | |
|---|---|---|---|
| 3,429,606 | 2/1969 | Brasseur | 403/348 |
| 4,305,603 | 12/1981 | Muller | 280/14.2 |
| 4,739,564 | 4/1988 | Eser | 36/131 |
| 4,936,164 | 6/1990 | Forke | 74/594.6 |
| 4,964,649 | 10/1990 | Chamberlin | 280/14.2 |
| 5,284,066 | 2/1994 | Weiss | 36/131 |
| 5,354,088 | 10/1994 | Vetter et al. | 280/14.2 |

FOREIGN PATENT DOCUMENTS

| | | | |
|---|---|---|---|
| 2240102 | 2/1974 | Germany | 36/131 |
| 2418867 | 10/1975 | Germany | 280/613 |
| 3315282 | 10/1984 | Germany | 36/131 |
| 3329993 | 3/1985 | Germany | 74/594.6 |

*Primary Examiner*—Karin L. Tyson

[57] ABSTRACT

A snowboard binding including of a binding plate mounted to the snowboard. A binding having a rubber insulator is secured to the binding plate. The binding has an insert aperture, an insert position, a locked position, and a pair of stopping means therebetween. The insert position corresponds with the insert aperture. The locked position is rotatably perpendicular to the insert position. The stopping means serves to prevent the locked position from rotating beyond perpendicular. A boot has a walking peg secured to the heel and to the toe. The boot has a boot binding theresecured. The boot binding corresponds with the insert aperture and the insert position of the binding. The boot binding is capable of rotating the binding from the insert position to the locked position.

1 Claim, 4 Drawing Sheets

FIG 7
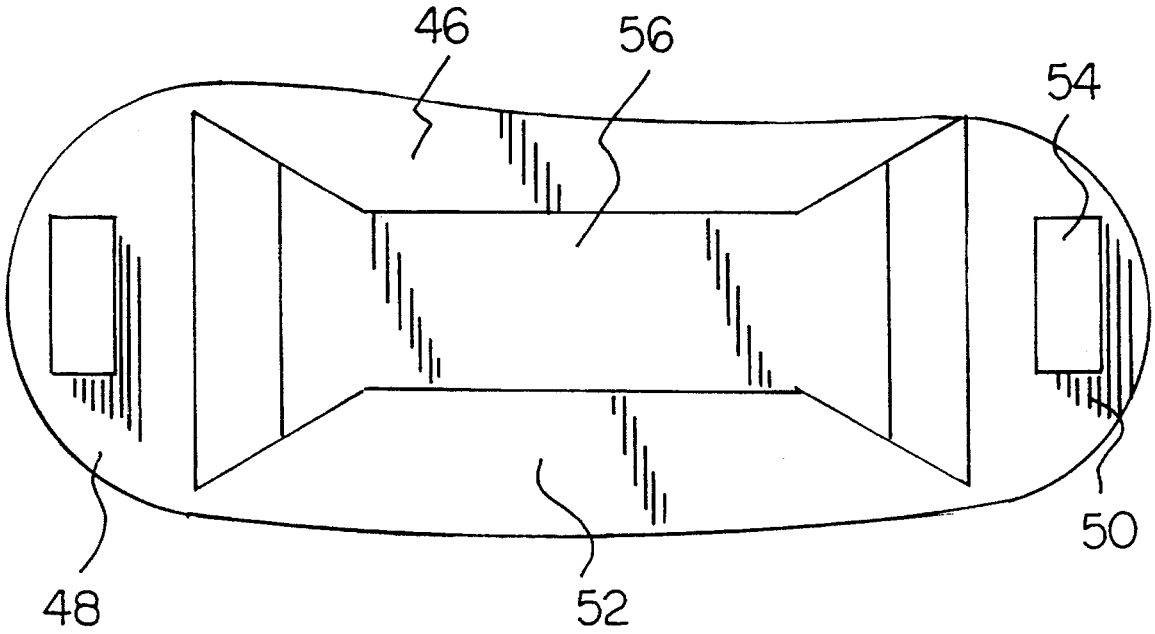
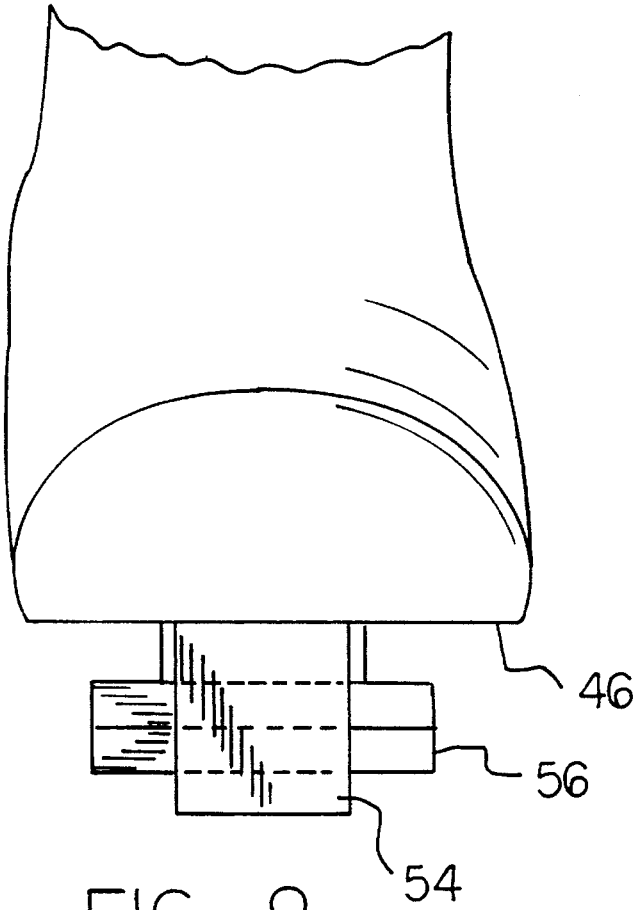
FIG 8

SNOWBOARD BINDING AND BOOT INCLUDING COMPLEMENTARY OPENING AND BINDING MEMBER

BACKGROUND OF THE INVENTION

1. Field of the Invention

The present invention relates to a no-sit snowboard binding and more particularly pertains to allowing a user to be mounted from a standing position onto a snowboard with a no-sit snowboard binding.

2. Description of the Prior Art

The use of binding systems is known in the prior art. More specifically, binding systems heretofore devised and utilized for the purpose of securing a user to a snowboard are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,028,068 to Donovan discloses a quick-action adjustable snow boot binding mounting.

U.S. Pat. No. 5,261,689 to Carpenter et al. discloses a snowboard binding system.

U.S. Pat. No. 5,172,924 to Barci discloses a hard shell boot snow board bindings and system.

U.S. Pat. No. 5,145,202 to Miller discloses a snowboard release binding.

U.S. Pat. No. 5,085,455 to Bogner et al. discloses a sporting board with two boot bindings.

While these devices fulfill their respective, particular objective and requirements, the aforementioned patents do not describe a no-sit snowboard binding that allowing a user to be mounted from a standing position onto a snowboard.

In this respect, the no-sit snowboard binding according to the present invention substantially departs from the conventional concepts and designs of the prior art, and in doing so provides an apparatus primarily developed for the purpose of allowing a user to be mounted from a standing position onto a snowboard.

Therefore, it can be appreciated that there exists a continuing need for new and improved no-sit snowboard binding which can be used for allowing a user to be mounted from a standing position onto a snowboard. In this regard, the present invention substantially fulfills this need.

SUMMARY OF THE INVENTION

In the view of the foregoing disadvantages inherent in the known types of binding systems now present in the prior art, the present invention provides an improved no-sit snowboard binding. As such, the general purpose of the present invention, which will be described subsequently in greater detail, is to provide a new and improved no-sit snowboard binding and method which has all the advantages of the prior art and none of the disadvantages.

To attain this, the present invention essentially comprises a binding plate having an upper surface, a lower surface, and a plurality of apertures formed therethrough. The lower surface mounted to the snowboard. A plurality of fastening means secures the binding plate to the snowboard through the plurality of apertures therethrough. The device contains a binding having an upper surface, a lower surface, and an intermediate surface therebetween. The lower surface has a rubber insulator theresecured. The lower surface is secured to the upper surface of the binding plate. The upper surface comprises an insert aperture having an oblong appearance. The intermediate surface has an insert position, a locked position, and a pair of stopping means therebetween. The insert position corresponds with the insert aperture of the upper surface. The locked position is rotatably perpendicular to the insert position. The stopping means serves to prevent the locked position from rotating beyond perpendicular. The device contains a boot having an upper portion and a lower portion. The upper portion resembles a snowboarding boot. The lower portion has a toe section, a heel section, and an intermediate extent therebetween. The toe section has a walking peg theresecured. The heel portion has a walking peg theresecured. The intermediate extent has a boot binding theresecured. The boot binding corresponds with the insert aperture of the upper surface of the binding and the insert position of the intermediate surface of the binding. The boot binding is capable of rotating the intermediate surface of the binding from the insert position to the locked position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved no-sit snowboard binding which has all the advantages of the prior art binding systems and none of the disadvantages.

It is another object of the present invention to provide a new and improved no-sit snowboard binding which may be easily and efficiently manufactured and marketed.

It is a further object of the present invention to provide a new and improved no-sit snowboard binding which is of durable and reliable construction.

An even further object of the present invention is to provide a new and improved no-sit snowboard binding which is susceptible of a low cost of manufacture with regard to both materials and labor, and which accordingly is then susceptible of low prices of sale to the consuming public, thereby making such a no-sit snowboard binding economically available to the buying public.

Still yet another object of the present invention is to provide a new and improved no-sit snowboard binding which provides in the apparatuses and methods of the prior art some of the advantages thereof, while simultaneously overcoming some of the disadvantages normally associated therewith.

Even still another object of the present invention is to provide a new and improved no-sit snowboard binding for allowing a user to be mounted from a standing position onto a snowboard.

Lastly, it is an object of the present invention to provide a new and improved no-sit snowboard binding comprised of a binding plate mounted to the snowboard. A binding having a rubber insulator is secured to the binding plate. The binding has an insert aperture, an insert position, a locked position, and a pair of stopping means therebetween. The insert position corresponds with the insert aperture. The locked position is rotatably perpendicular to the insert position. The stopping means serves to prevent the locked position from rotating beyond perpendicular. A boot has a walking peg secured to the heel and to the toe. The boot has a boot binding theresecured. The boot binding corresponds with the insert aperture and the insert position of the binding. The boot binding is capable of rotating the binding from the insert position to the locked position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a bottom view of the boot taken along line 7—7 of FIG. 6.

FIG. 8 is a front view of the boot taken along line 8—8 of FIG. 5.

The same reference numerals refer to the same parts through the various Figures.

DESCRIPTION OF THE PREFERRED EMBODIMENT

Figure 1:
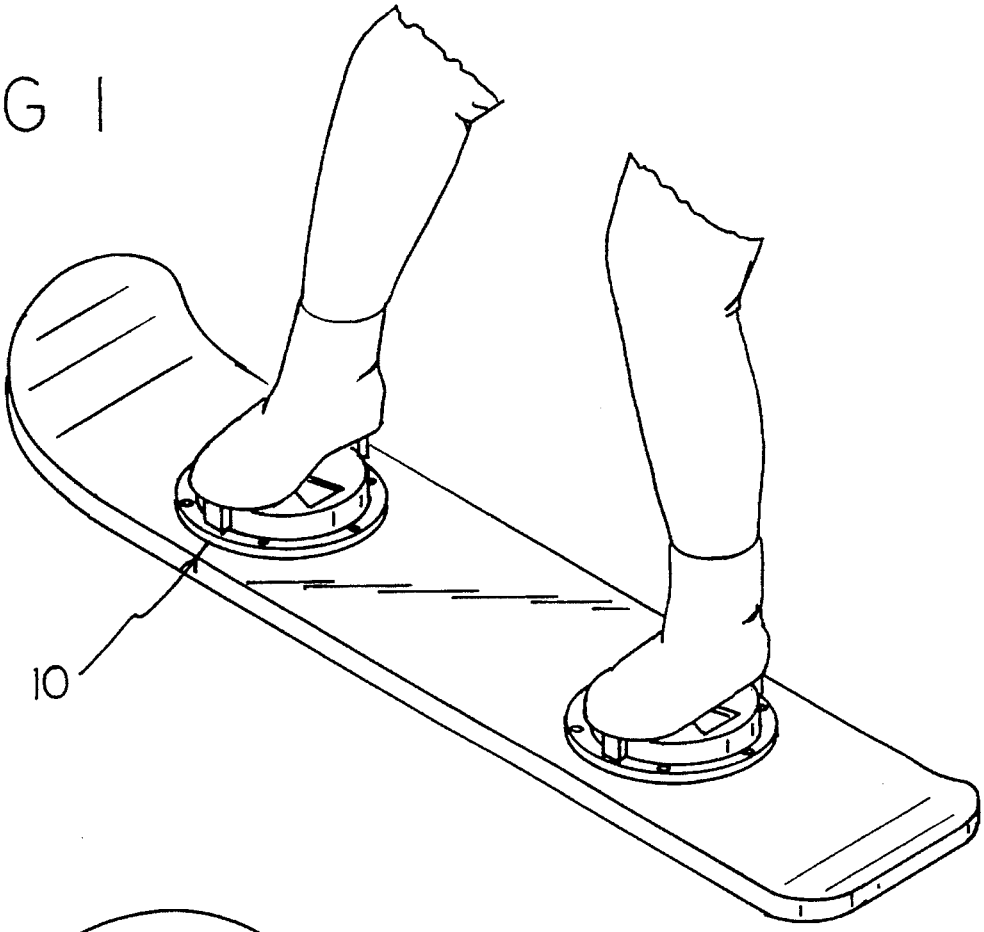
FIG. 1 is a perspective view of the preferred embodiment of the no-sit snowboard binding constructed in accordance with the principles of the present invention.
Figure 2:
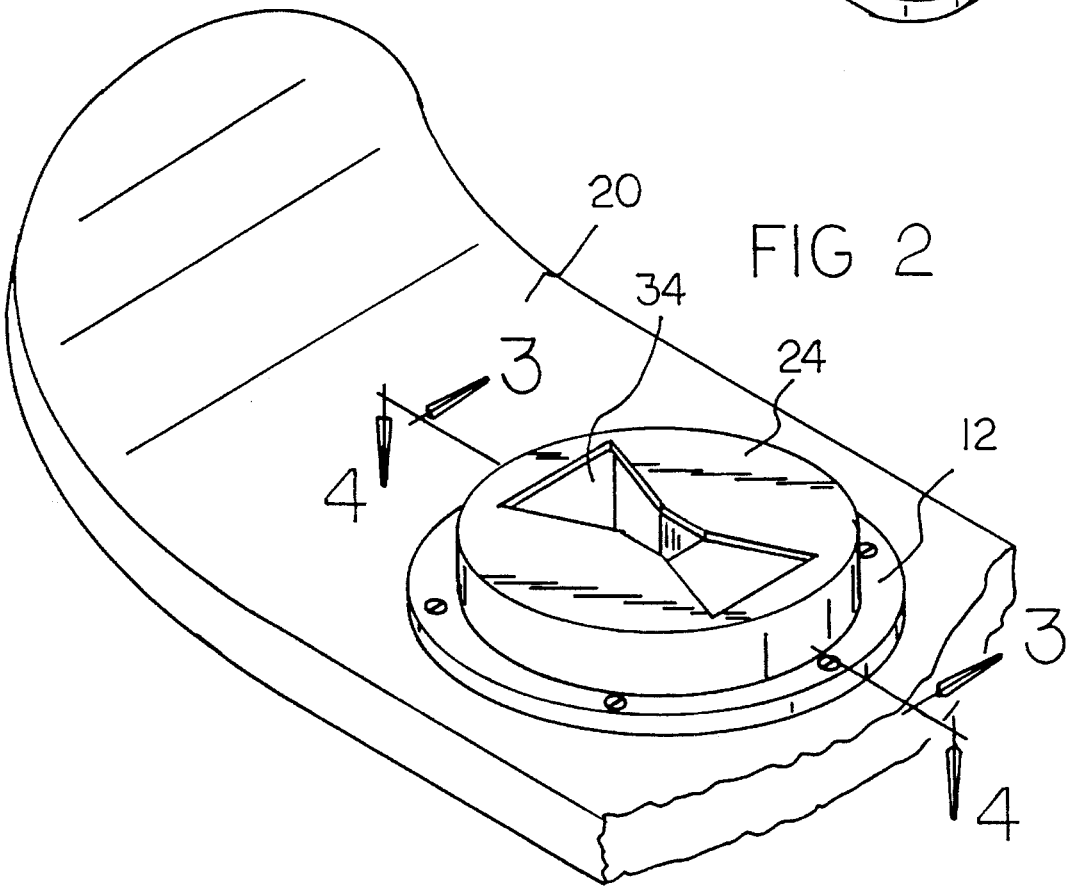
FIG. 2 is a perspective view of the binding of the present invention.
Figure 3:
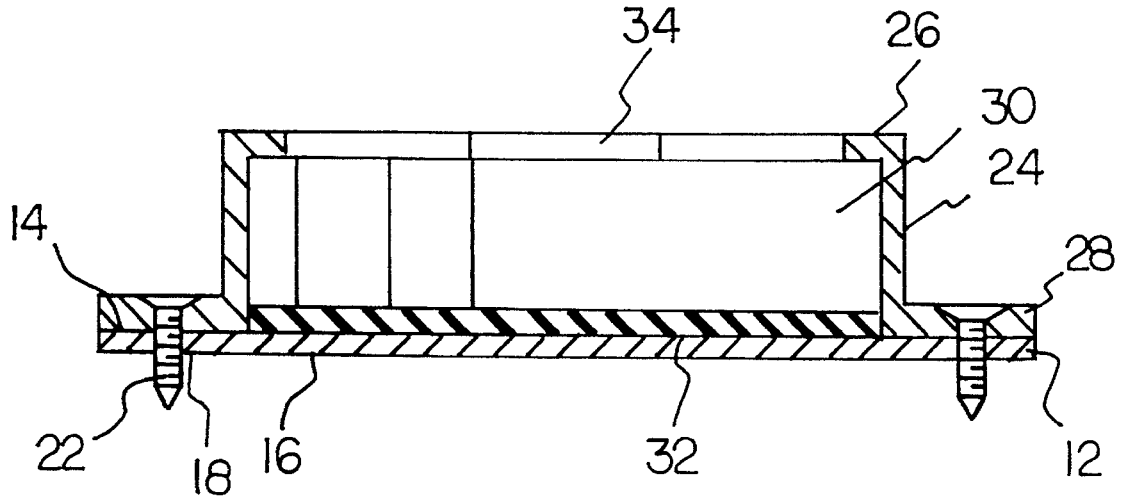
FIG. 3 is a cross-sectional view taken along line 3—3 of FIG. 2.
Figure 4:
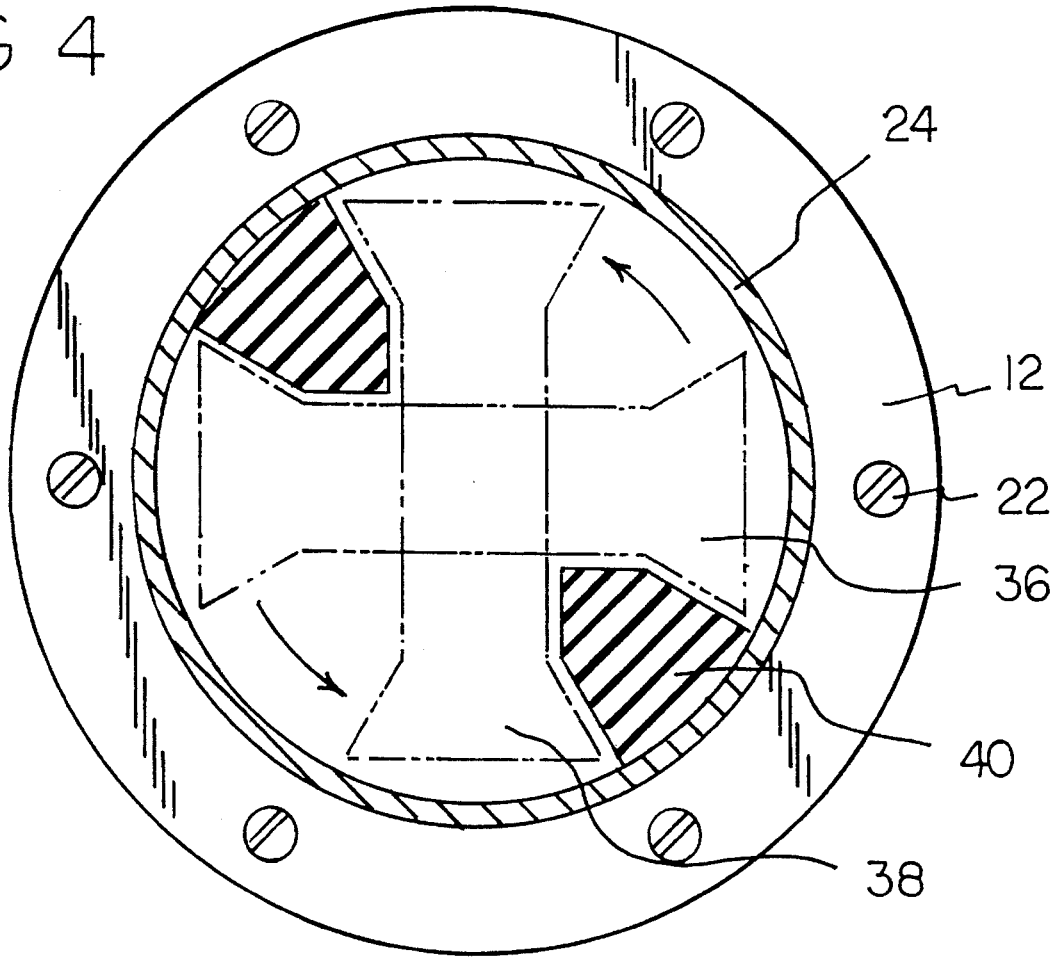
FIG. 4 is a cross-sectional view taken along line 4—4 of FIG. 2.
Figure 5:
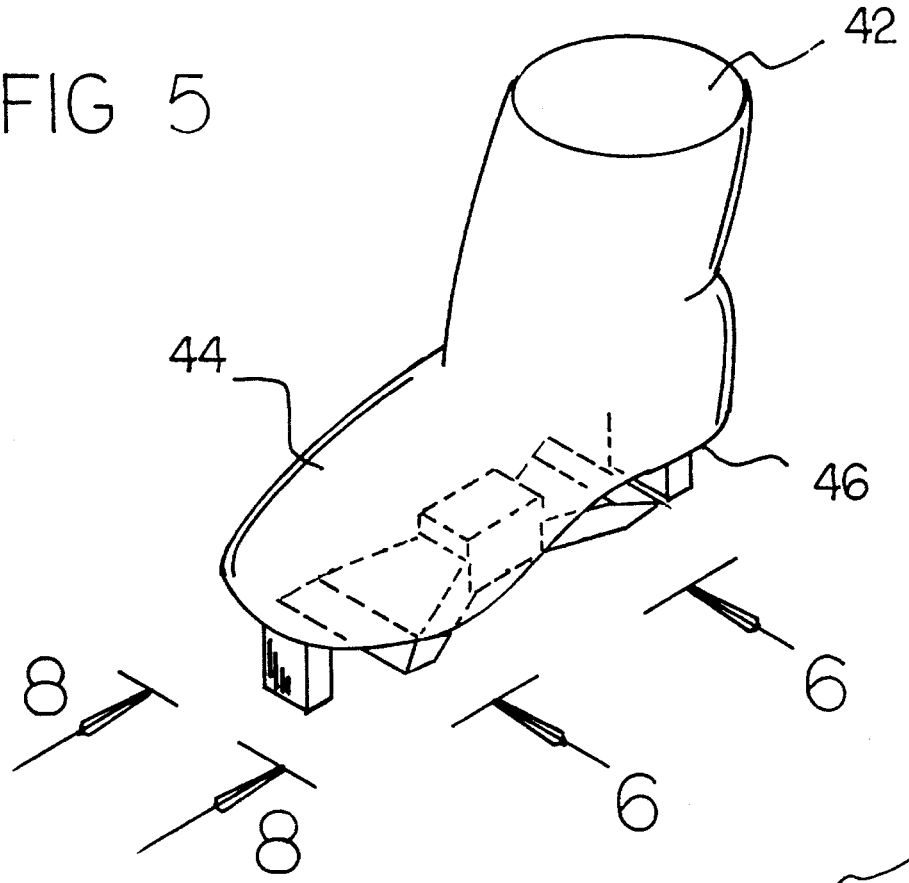
FIG. 5 is a perspective view of the boot of the present invention.
Figure 6:
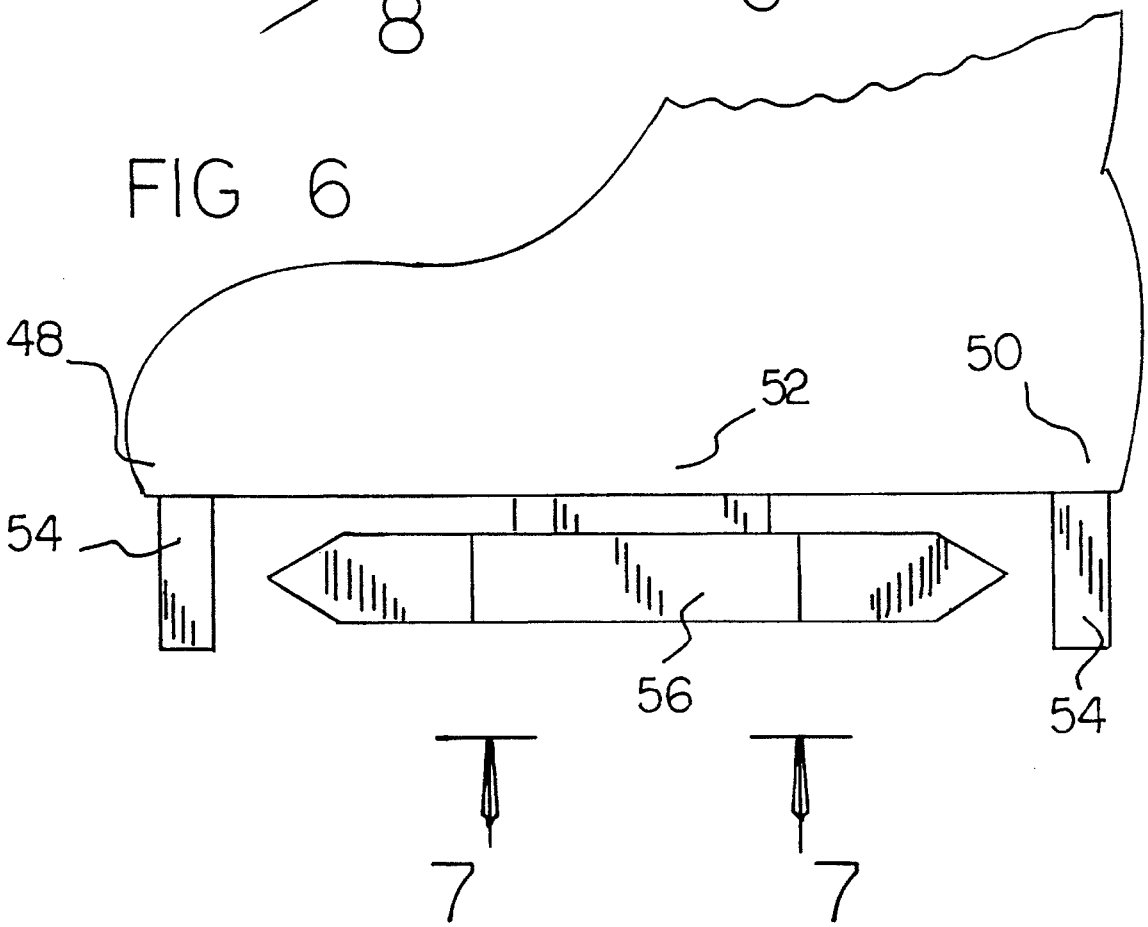
FIG. 6 is a side view of the boot taken along line 6— 6 of FIG. 5.

With reference now to the drawings, and in particular, to FIG. 1 thereof, the preferred embodiment of the new and improved no-sit snowboard binding embodying the principles and concepts of the present invention and generally designated by the reference number 10 will be described.

Specifically, it will be noted in the various Figures that the device relates to a new and improved no-sit snowboard binding for allowing a user to be mounted from a standing position onto a snowboard. In its broadest context, the device consists of a binding plate, a binding, and a boot.

The device 10 contains a binding plate 12 having an upper surface 14, a lower surface 16, and a plurality of apertures 18 formed therethrough. The lower surface 16 is mounted to the snowboard 20. A plurality of fastening means 22 secure the binding plate 12 to the snowboard 20 through the plurality of apertures 18. The preferable fastening means incorporated for the device are threaded screws. The binding plate 12 has a circular periphery and the plurality of apertures 18 are positioned at equal points surrounding the binding plate to create a more durable securement.

The device 10 contains a binding 24 having an upper surface 26, a lower surface 28, and an intermediate surface 30 therebetween. The intermediate surface 30 contains the only elements of the binding 24 that move. A rubber insulator 32 engages the upper surface of the binding plate and opposite the insert aperture. The lower surface 28 is secured to the upper surface 14 of the binding plate 12. The upper surface 26 comprises an insert aperture 34 having an oblong appearance. The intermediate surface 30 has an insert position 36, a locked position 38, and a pair of stopping means 40 therebetween. The insert position 36 corresponds with the insert aperture 34 of the upper surface 26. The locked position 38 is rotatably perpendicular to the insert position 36. The locked position 38 turns to a position at a 90 degree angle to the insert position 36 when the user is prepared to snowboard. When the user wishes to disengage, he simply rotates back the 90 degrees to return to the insert position 36. The stopping means 40 serves to prevent the locked position 38 from rotating beyond perpendicular. The stopping means 40 is preferably a rubber bumper that also prevents the binding 24 from rotating beyond the insert position 36.

The device 10 contains a boot 42 having an upper portion 44 and a lower portion 46. The upper portion 44 resembles a snowboarding boot. The lower portion 46 has a toe section 48, a heel section 50, and an intermediate extent 52 therebetween. The toe section 48 has a walking peg 54 theresecured. The heel portion 50 has a walking peg 54 theresecured. The intermediate extent 52 has a boot binding 56 theresecured. The walking pegs 54 give the user to balance for walking when not inserted into the binding. The boot binding 56 corresponds with the insert aperture 34 of the upper surface 26 of the binding 24 and the insert position 36 of the intermediate surface 30 of the binding 24. The boot binding 56 fits snugly against the rubber insulator 32 to provide a means for preventing snow and ice to enter into the binding 24. The boot binding 56 is capable of rotating the intermediate surface 30 of the binding 24 from the insert position 36 to the locked position 38 for a position ready to perform snowboarding and also for rotating the intermediate surface 30 of the binding 24 from the locked position 38 back to the insert position 36 to release from the binding 24.

The binding plate is attached to the snowboard and provides a surface for the insulator, the binding 24 has a rounded outer surface with a diameter and an insert aperture in the top surface thereof. The boot has a binding element 56 that fits into the insert aperture and retains the boot to the binding 24 when the boot binding has been inserted into the aperture and the boot has been turned about ninety degrees to the insert aperture. The two stopping means 40 define the locked position of the boot binding and the walking pegs 54 are spaced at a distance along the boot greater than the diameter of the rounded outer surface of the binding 24 so that when the boot binding is inserted into the insert aperture, the walking pegs 54 are adjacent to the rounded outer surface.

The present invention is a step-in binding system for snowboard skiing. It allows the snowboard to be mounted from a standing position, rather than while sitting in the snow.

This invention utilizes a bayonet joint locking design, with one member incorporated into each ski boot, and the receiving members mounted on the board. The binding members are made of high strength plastics which are suited to cold temperatures, with metal wear plates and rubber cushioning. The boots resemble skates which have wide flat blades with wedge shapes at each end. Posts extend down from the toes and heels to support the skier when walking.

The skier places the boots on the openings in the mountings, which are in line with the length of the board. By turning the feet 90 degrees, the boot blades wedge under ledges in the mountings, locking the boot in the snowboard. Stops are provided to limit the turning so the snowboarder is in the correct position, which is facing at a right angle to the direction in which the board moves. A 90 degree turn in the other direction releases the boots from the bindings.

The bindings may be entered from either side of the board, depending on whether the right or left leg is to be forward. Current bindings are little more than straps.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A snowboard binding and boot including complementary opening and binding members comprising, in combination:

a snowboard having an upper surface and a lower surface;

a binding plate having an upper surface, a lower surface, and a plurality of apertures formed therethrough, the lower surface mounted to the upper surface of the snowboard, a plurality of fastening means securing the binding plate to the snowboard through the plurality of apertures therethrough;

a binding having a round outer surface, a lower surface, and an intermediate surface therebetween, the lower surface having a rubber insulator theresecured, the rubber insulator engaging the upper surface of the binding plate and opposite the aperture, the round outer surface having a diameter and an insert aperture having an oblong appearance, the intermediate surface having an insert position, a locked position, and a pair of stopping means therebetween, the insert position corresponding with the insert aperture of the round outer surface, the locked position being rotatably perpendicular to the insert position, the stopping means serving to determine the locked position;

a boot having an upper portion and a lower portion, the upper portion resembling a snowboarding boot, the lower portion having a toe section, a heel section, and an intermediate extent therebetween, the toe section having a walking peg theresecured, the heel portion having a walking peg theresecured, the intermediate extent having a boot binding theresecured, the boot binding corresponding with the insert aperture of the rounded outer surface of the binding and the insert position of the intermediate surface of the binding, the binding retaining the boot after the boot rotates ninety degrees from the insert aperture whereby the two stopping means defining a locked position and the walking pegs of the toe section and the heel portion being spaced at a distance along the boot greater than the diameter of the rounded outer surface of the binding whereby when the boot binding is inserted into the binding aperture, the walking pegs being adjacent the rounded outer surface.

* * * * *